US006891956B2

(12) United States Patent
Heerlein et al.

(10) Patent No.: US 6,891,956 B2
(45) Date of Patent: May 10, 2005

(54) CERUMEN PROTECTION SYSTEM FOR HEARING AID DEVICES

(75) Inventors: Markus Heerlein, Kitzingen (DE); Christian Schmitt, Grossenseebach (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 31 days.

(21) Appl. No.: 10/401,805

(22) Filed: Mar. 28, 2003

(65) Prior Publication Data

US 2003/0198361 A1 Oct. 23, 2003

(30) Foreign Application Priority Data

Mar. 28, 2002 (DE) ..... 102 14 189

(51) Int. Cl.[7] ..... H04R 25/00

(52) U.S. Cl. ..... 381/325; 381/322; 381/328; 381/380

(58) Field of Search ..... 381/322, 324, 381/325, 327, 328, 330, 380, 381, 382; 181/129, 130, 135

(56) References Cited

U.S. PATENT DOCUMENTS 4,972,488 A 11/1990 Weiss et al.
4,987,597 A * 1/1991 Haertl ..... 381/325
5,068,901 A * 11/1991 Carlson ..... 381/325
6,449,373 B2 * 9/2002 Baker ..... 381/325

FOREIGN PATENT DOCUMENTS

| | | |
|---|---|---|
| DE | 39 17 804 | 12/1990 |
| DE | 94 14 115.0 | 12/1994 |
| DE | 691 08 090 | 10/1995 |
| DE | 196 40 796 | 4/1998 |
| DE | 101 04 129 | 8/2002 |
| EP | 0 455 203 | 3/1995 |
| WO | WO 00/45617 | 8/2000 |

* cited by examiner

*Primary Examiner*—Huyen D. Le
(74) *Attorney, Agent, or Firm*—Schiff Hardin LLP

(57) ABSTRACT

A device is provided for earphones that are introduced into the auditory canal that provide protection against cerumen in which the sound from the earphone is conducted onto a membrane that is arranged essentially parallel to the auditory canal. Proceeding from the membrane, the sound is forwarded onto the tympanum, where the membrane at least partially seals the earphone so that cerumen is kept away from the earphone. The membrane, including the earphone, can be removed from the hearing aid housing for cleaning purposes.

4 Claims, 4 Drawing Sheets

CERUMEN PROTECTION SYSTEM FOR HEARING AID DEVICES

BACKGROUND OF THE INVENTION

1. Field of the Invention

The present invention is directed to a device for supplying sound to a tympanum that is introducible into an auditory canal, comprising a housing that comprises an essentially cylindrical housing section at an end facing toward the tympanum, comprising an earphone device for the output of sound signals, comprising a sound exit opening in the housing at that side of the housing facing toward the tympanum, and comprising a cerumen protection device that is integrated into the housing for protecting the earphone against cerumen penetrating through the sound exit opening. The present invention is also directed to a corresponding method for supplying sound to the tympanum.

2. Description of the Related Art

Contamination of an earphone by cerumen can occur in hearing aids as well as other earphone devices that can be at least partially inserted into the auditory canal. This frequently leads to outages of the earphone, particularly of in-the-ear hearing aids (ITE).

Open cerumen protection systems have been mainly previously utilized for solving this problem, so that the cerumen cannot proceed to the earphone without further efforts. However, such open cerumen protection systems cannot always prevent the contamination of the earphone.

As an alternative solution, the German patent document DE 196 40 796 A1 discloses a hearing aid in which the earphone is closed off from the tympanum by a membrane. International Patent Application WO-A-0045617 likewise discloses a treatment device that has a sound exit opening that is sealed by an acoustically transmissive, watertight film. The membrane that shields the earphone from the auditory canal, however, is comparatively small, so that clearly perceptible attenuations of the sound to be transmitted from the earphone to the tympanum occur.

German Published Application DE 101 04 129 A1 also discloses a hearing aid with filter unit. The filter unit serves for protection against cerumen and has a planar, membrane-like or sieve-like filter unit. When the filter element is implemented slanted, a larger, effective transmission area for the sound can be created, where the risk of blockage or contamination of the filter element is additionally reduced due to the inclination and the larger effective area. Angles of inclination between 45° and 90° are preferred. In the latter instance, the planar filter element lies along the central sound direction.

SUMMARY OF THE INVENTION

The object of the present invention is to provide a device and a method for supplying sound to the tympanum in which disturbing influences due to cerumen are minimized.

This object is inventively achieved by a device for supplying sound to a tympanum that is introducible into an auditory canal, comprising a housing that comprises an essentially cylindrical housing section at an end facing toward the tympanum, comprising an earphone device for the output of sound signals, comprising a sound exit opening in the housing at that side of the housing facing toward the tympanum, and comprising a cerumen protection device that is integrated into the housing for protecting the earphone against cerumen penetrating through the sound exit opening, and that comprises a membrane that is arranged essentially parallel to the cylinder axis of the cylindrical housing section and that picks up the sound of the earphone for forwarding to the sound exit opening, where the cerumen protection device comprises a receptacle device in which the membrane and the earphone are integrated such that the membrane and the earphone can be removed from the housing at the side facing toward the tympanum.

Inventively, thus, the earphone can be sealed against penetrating cerumen by the membrane, whose area can be selected large enough so that perceptible attenuations of the sound emitted by the earphone do not occur. The reason for this is that, first, the transmission properties are better given larger membranes than small ones. Second, the large membrane area also has the advantage that it cannot be as quickly covered with cerumen, so that perceptible attenuations can be avoided over a longer time.

The membrane integrated into the housing in the longitudinal direction of the housing also has the advantage that it provides less of an attack area upon insertion into the auditory canal than membranes that are planarly mounted at the end face of the housing, i.e., transversely relative to the auditory canal. The risk of tearing upon insertion can thus be reduced.

DESCRIPTION OF THE DRAWINGS

The present invention is explained below in greater detail on the basis of the attached drawings.

DETAILED DESCRIPTION OF THE INVENTION

The embodiments described below are preferred exemplary embodiments of the present invention and should not be construed as limiting the invention.

Figure 1:
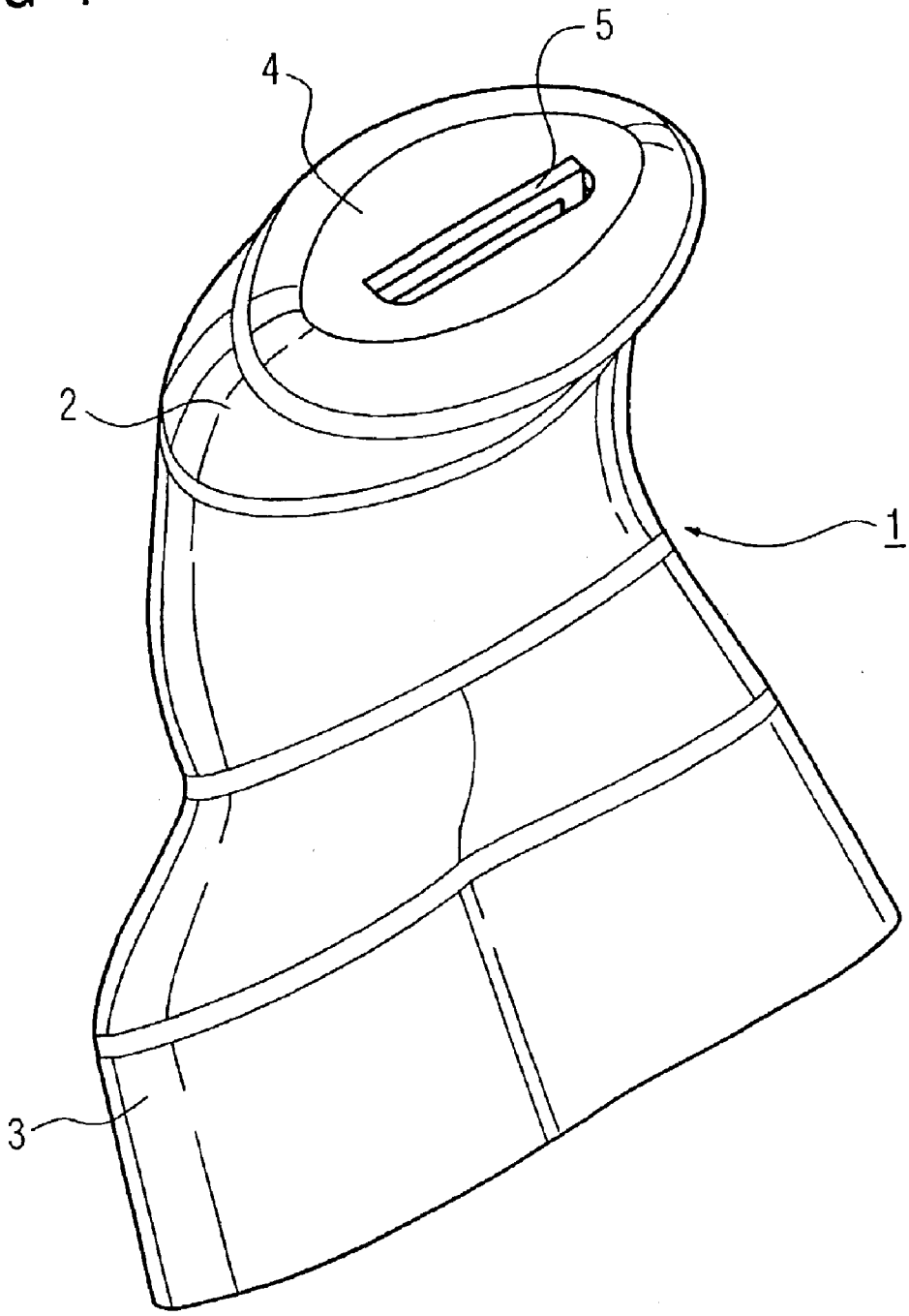
FIG. 1 is a pictorial perspective view of the housing of an ITE hearing aid.

FIG. 1 shows a housing 1 of an ITE hearing aid that reflects the individual contours of an auditory canal. The housing 1 is approximately cylindrical, and the housing section 2 facing toward the tympanum comprises a smaller circumference than the housing section 3 facing toward the outer ear. At its side facing toward the tympanum, the housing 1 comprises an end face 4 that proceeds essentially perpendicular to the auditory canal when the hearing aid is inserted into the ear. The end face 4 comprises an oblong sound exit opening 5 through which the sound can proceed from the earphone to the tympanum.

It is especially advantageous when the cerumen protection device comprises a receptacle device into which the membrane can be plugged, potentially together with the earphone. The possibility thus derives that the earphone and the membrane can be easily replaced or cleaned. Beneficially, the receptacle device may be arranged such that the membrane and the earphone can be removed from the housing at that side facing toward the tympanum.

Figure 2:
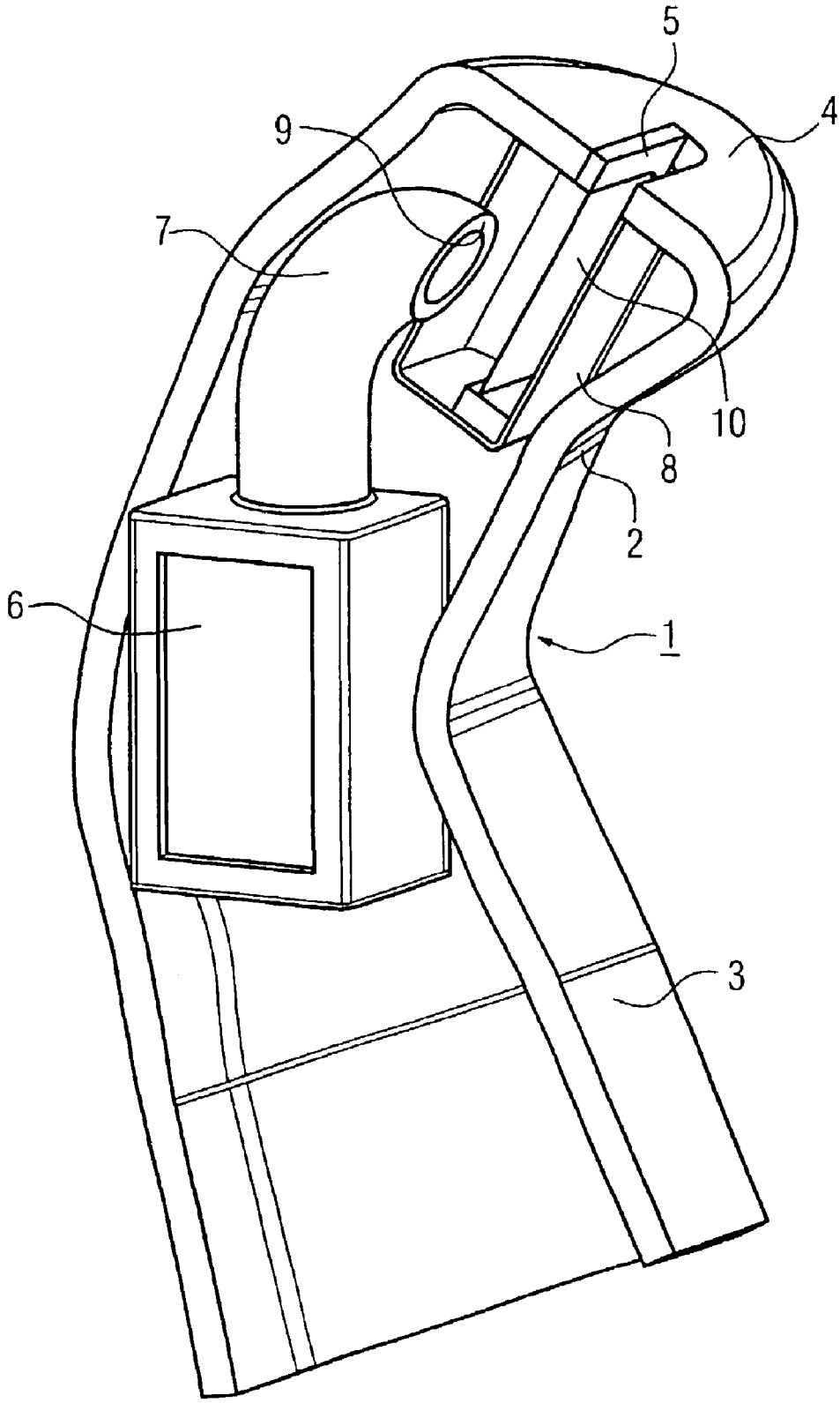
FIG. 2 is a pictorial sectional view through a hearing aid according to a first embodiment of the present invention.

FIG. 2 represents a cut housing 1 into which an earphone 6 is installed. The earphone 6 first conducts the generated sound via a sound-guide tube 7 into a shell or receptacle device 8. To this end, the receptacle device 8 has a sound admission opening 9 that accepts the sound-guide tube 7 or at which the sound-guide tube 7 can be mounted.

The shell or receptacle device 8 is mounted fixed to the housing 1 at the end face 4 below the sound exit opening 5. A membrane 10 can be inserted into the shell 8 through the sound exit opening 5. The area of the membrane 10 is larger than the area of the end face 4 of the housing that faces toward the tympanum. In its inserted condition, the membrane 10 divides the inside of the shell 8 into two parts, whereby the sound admission opening belongs to the one part and the sound exit opening belongs to the other. In its inserted condition, further, the membrane 10 is situated opposite the sound admission opening 9 of the shell 8, and the sound entering into the shell 8 causes the membrane 10 to oscillate. The membrane 10 transmits the sound into the other part of the shell, so that it can proceed through the sound exit opening 5 to the tympanum. Due to the sealing effect of the membrane 10, however, it is hardly possible for cerumen that invades the shell 8 in the sound exit opening 5 from the auditory canal to penetrate to the earphone 6. The risk of contaminating the earphone 6, which results in earphone inoperability, is thus greatly reduced.

Over and above this, the membrane 10, which can be embedded in a suitable frame, can be removed from the sound exit opening 5 for cleaning. Beneficially, the frame in which the membrane 10 is clamped may have an L-shaped continuation at that side lying opposite the sound exit opening 5. The cerumen that has penetrated into the gap between the shell wall and the membrane can also be removed with this L-shaped continuation upon removal of the membrane 10.

Figure 3:
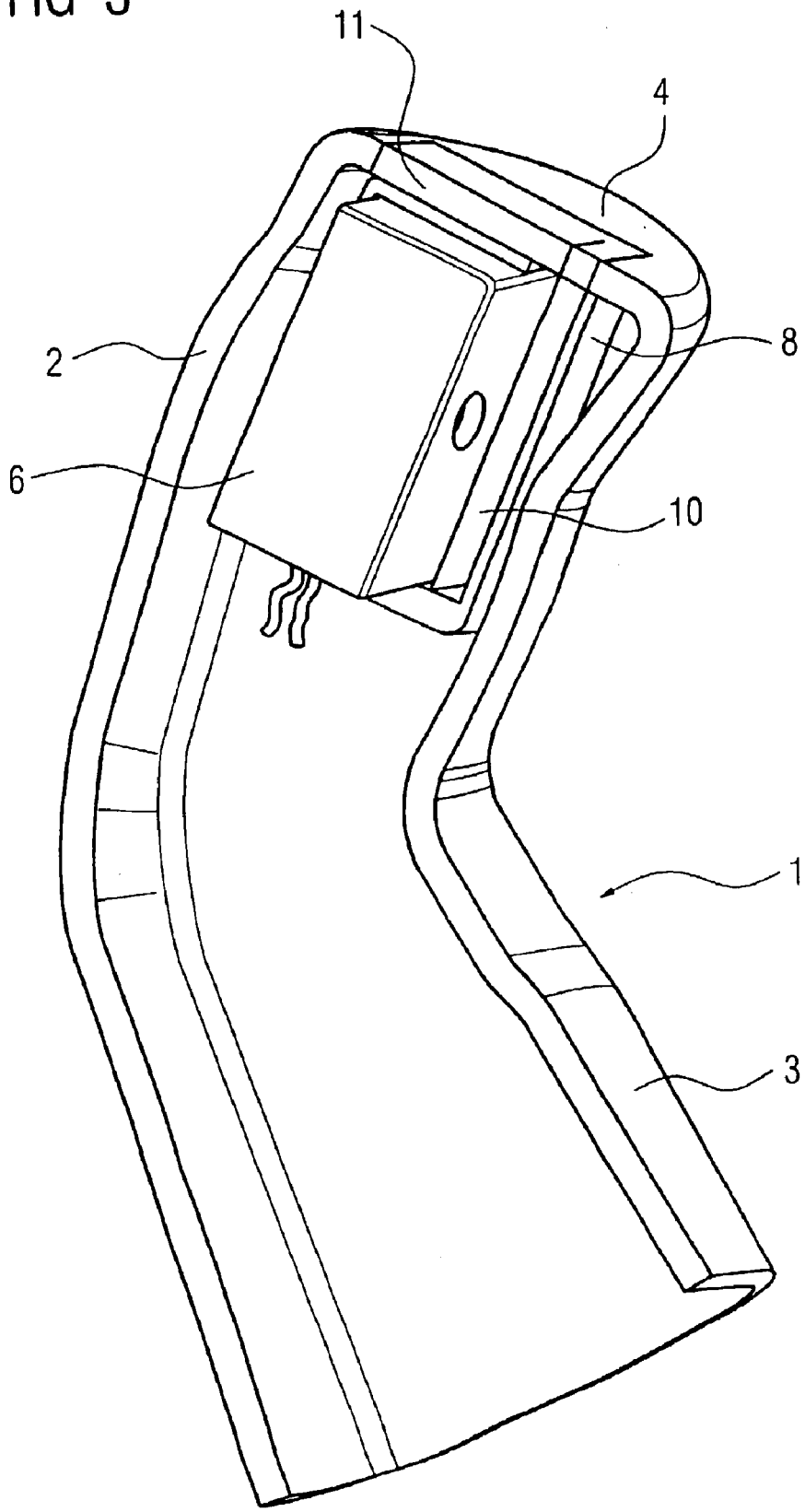
FIG. 3 is a pictorial a sectional view through a hearing aid according to a second embodiment of the present invention.

When the anatomy of the auditory canal allows it, the housing—according to FIG. 3—can comprise a larger diameter in the region of the housing section 2 facing toward the tympanum than does the housing shown in FIG. 2. The earphone 6 together with the cerumen protection device, which is composed of the shell 8 including the membrane 10, can then be arranged directly under the end face 4 of the housing. A sound-guide tube 7 for conducting the sound from the earphone 6 to the membrane 10 is thus not needed. On the contrary, the earphone 6 can be directly accommodated in the shell or receptacle device 8, so that the earphone 6 can directly supply the membrane 10 with sound. In this case, the sound exit opening of the earphone 6 lies at its side lying opposite the membrane.

Figure 4:
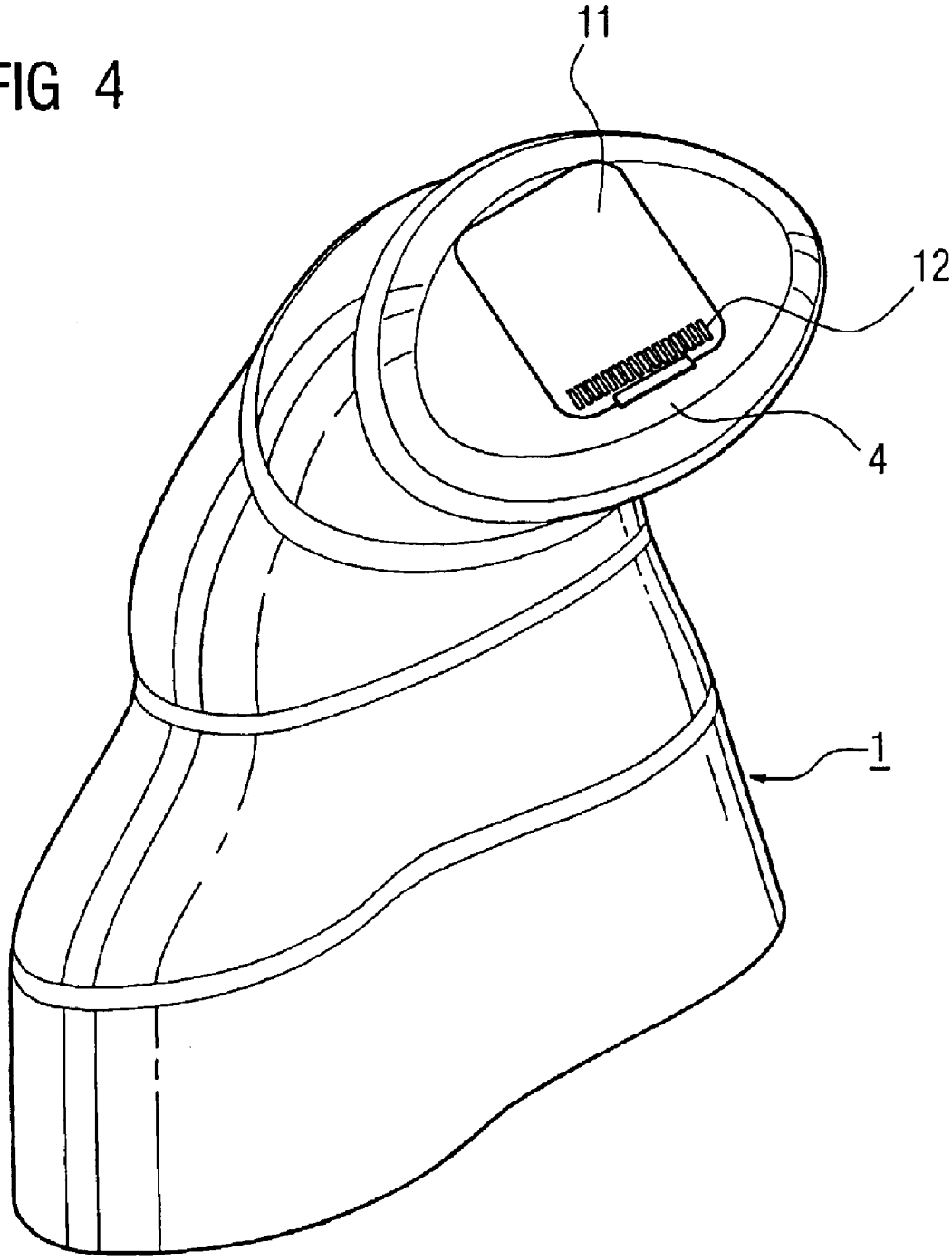
FIG. 4 is a pictorial a perspective view onto the housing according to the second embodiment.

FIG. 4 shows the end face 4 of the housing 1 that comprises a removable cover 11 in this second embodiment of the present invention, the shell 8 being attached to the underside of said cover 11. Upon removal of the cover, thus, the earphone 6 together with the membrane 10 and the shell 8 can be removed from the hearing aid. The membrane 10 can thus be easily cleaned and the earphone 6 can also be replaced without further effort.

In this embodiment, the sound guidance following the membrane, as in the first embodiment, ensues between the membrane and the wall of the shell 8 to the sound exit opening 5, which is closed by the cover 11 in the present case, this cover 11 comprising slot-shaped passages 12 in the region of the sound exit openings. The transmission slots 12 assure the passage of the sound but also simultaneously prevent the penetration of larger cerumen constituents into the sound exit opening 5.

The advantage of the second embodiment is comprised therein that the earphone 6 together with the cerumen protection device 6, 8 can be removed as a complete module for replacement purposes or cleaning. Depending on the earphone geometry, however, this is only possible in ITE hearing aids whose users have an adequately large auditory canal.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The particular implementations shown and described herein are illustrative examples of the invention and are not intended to otherwise limit the scope of the invention in any way. Moreover, no item or component is essential to the practice of the invention unless the element is specifically described as "essential" or "critical". Numerous modifications and adaptations will be readily apparent to those skilled in this art without departing from the spirit and scope of the present invention.

LIST OF REFERENCE CHARACTERS

1 housing
2 housing section
3 housing section
4 end face
5 sound exit opening
6 earphone
7 sound-guide lube
8 receptacle device/shell
9 sound admission opening
10 membrane
11 cover
12 transmission slots

What is claimed is:

1. A device for supplying sound to a tympanum that is introducible into an auditory canal, comprising:

a housing that comprises an essentially cylindrical housing section at an end facing toward a tympanum;

an earphone integrated into the housing configured to output sound signals;

a sound exit opening in the housing at a side of the housing facing toward the tympanum; and a cerumen protection device that is integrated into the housing for protecting the earphone against cerumen penetrating through the sound exit opening, and that comprises:

a membrane that is arranged essentially parallel to a cylinder axis of the cylindrical housing section and that picks up an earphone sound for forwarding to the sound exit opening, a receptacle device in which the membrane and the earphone are integrated and configured such that the membrane and the earphone can be removed from the housing at the side facing toward the tympanum.

2. The device according to claim 1, wherein the receptacle device can be removed from the housing at that side facing toward the tympanum.

3. The device according to claim 1, wherein the area of the membrane is larger than the area of the end face of the housing that faces toward the tympanum.

4. The device according to claim 1, wherein the device is an in-the-ear hearing aid.

* * * * *